US010068725B2

(12) United States Patent
Hebras et al.

(10) Patent No.: US 10,068,725 B2
(45) Date of Patent: Sep. 4, 2018

(54) TOUCH-ACTION ELECTRIC SWITCH WITH PRE-LOAD STROKE

(71) Applicant: C&K Components S.A.S., Dole (FR)

(72) Inventors: Jeremy Hebras, Athée (FR); Stéphane Hurtard, Dole (FR); Rémi Martin, Foucherans (FR); Laurent Kubat, Dole (FR)

(73) Assignee: C&K Components S.A.S., Dole (FR)

( * ) Notice: Subject to any disclaimer, the term of this patent is extended or adjusted under 35 U.S.C. 154(b) by 0 days.

(21) Appl. No.: 15/371,270

(22) Filed: Dec. 7, 2016

(65) Prior Publication Data

US 2017/0178836 A1 Jun. 22, 2017

(30) Foreign Application Priority Data

Dec. 22, 2015 (FR) ..... 15 63037

(51) Int. Cl.

| | |
|---|---|
| ***H01H 1/10*** | (2006.01) |
| ***H01H 13/14*** | (2006.01) |
| ***H01H 13/26*** | (2006.01) |
| ***H01H 13/48*** | (2006.01) |

(52) U.S. Cl.

CPC ..... *H01H 13/14* (2013.01); *H01H 13/26* (2013.01); *H01H 13/48* (2013.01); *H01H 2203/032* (2013.01); *H01H 2215/006* (2013.01); *H01H 2227/028* (2013.01)

(58) Field of Classification Search

CPC ..... H01H 13/00; H01H 13/14; H01H 13/26; H01H 13/12; H01H 13/20; H01H 13/28; H01H 13/285; H01H 13/30; H01H 13/50; H01H 13/52; H01H 2003/00; H01H 2003/02; H01H 2003/12; H01H 2003/32; H01H 2205/00; H01H 2221/00; H01H 2221/01; H01H 2221/0152; H01H 1/2008; H01H 1/30; H01H 1/00; H01H 1/12; H01H 1/14; H01H 1/20; H01H 1/22; H01H 1/221; H01H 1/225; H01H 1/226; H01H 1/24; H01H 1/26; H01H 3/00; H01H 3/02; H01H 3/12

USPC ..... 200/517

See application file for complete search history.

(56) References Cited

U.S. PATENT DOCUMENTS

| | | | | |
|---|---|---|---|---|
| 4,851,626 | A | 7/1989 | Nagashima | |
| 7,109,431 | B2 | 9/2006 | Yanai et al. | |
| 7,841,791 | B2 * | 11/2010 | Iso | G06F 1/1616 400/472 |
| 8,546,708 | B2 | 10/2013 | Burnel et al. | |

(Continued)

FOREIGN PATENT DOCUMENTS

| | | |
|---|---|---|
| JP | H01144534 | 6/1989 |

*Primary Examiner* — Anthony R. Jimenez

(74) *Attorney, Agent, or Firm* — Fox Rothschild LLP

(57) ABSTRACT

An electric switch includes a base which receives a plurality of fixed electrical contacts and a movable electrical contact. The switch also includes an actuating body made of elastic material. The switch also includes a central, top, pushbutton. The body includes a lateral part, surrounding a top force-receiving portion. The pushbutton includes a lateral actuating surface for acting on this top lateral part of the body. When operated, successively, the central actuating surface of the pushbutton acts on the top force-receiving portion and elastically deforms a wall part of the body, and then the lateral actuating surface of the pushbutton acts on the top lateral part.

10 Claims, 15 Drawing Sheets

(56) References Cited

U.S. PATENT DOCUMENTS

| | | | | |
|---|---|---|---|---|
| 9,190,227 | B2 * | 11/2015 | Kato | H01H 13/14 |
| 2009/0107821 | A1 | 4/2009 | Ono | |

* cited by examiner

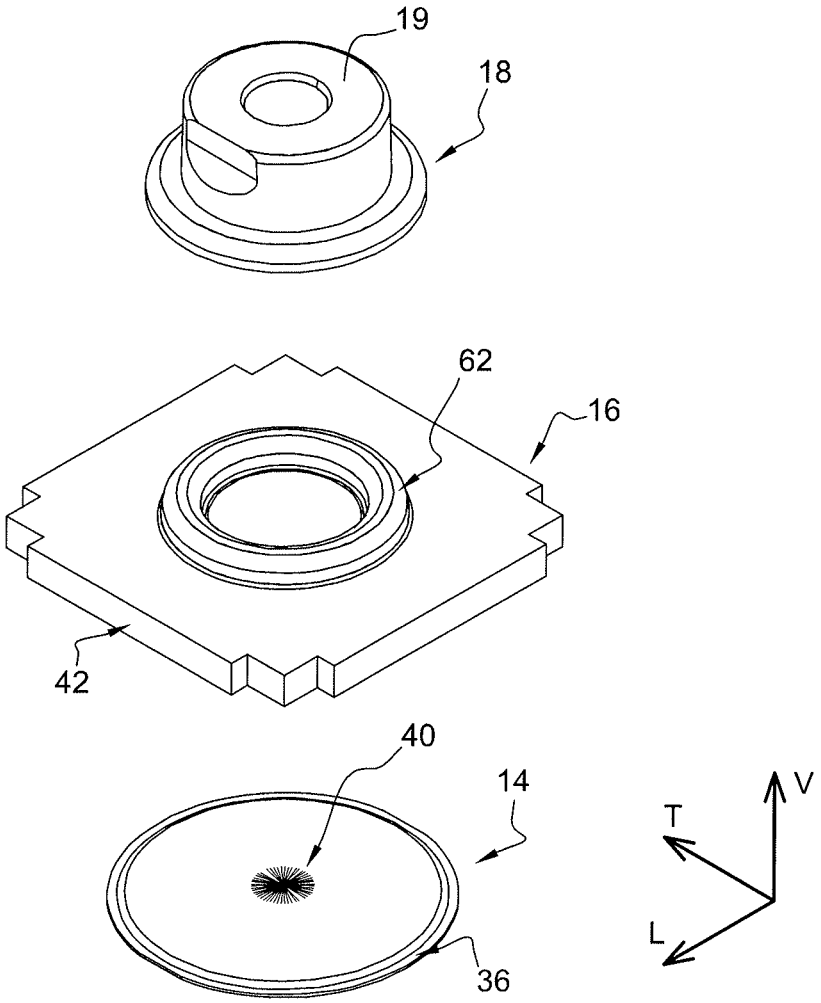
Fig. 10
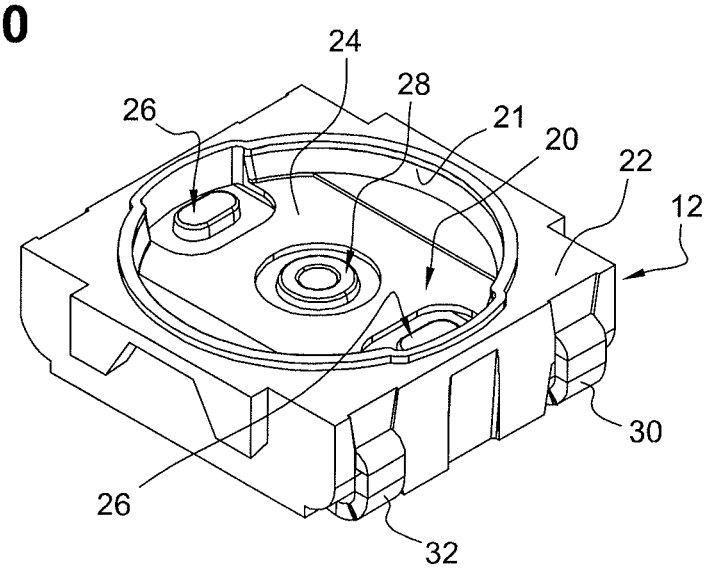

TOUCH-ACTION ELECTRIC SWITCH WITH PRE-LOAD STROKE

RELATED APPLICATIONS AND CLAIM OF PRIORITY

This patent document claims priority to France Patent Application number 1563037, filed Dec. 22, 2015, titled "Touch-Action Electric Switch With Pre-Load Stroke." The disclosure of the priority application is incorporated into this document by reference.

BACKGROUND

This patent document relates to a touch-action electric switch.

A touch-action electric switch with pre-load stroke is known for example from the U.S. Pat. No. 7,109,431 (the '431 patent). According to the solution described and illustrated in the '431 patent, it is difficult to control the value of the pre-load force exerted during the first phase or part of the operating stroke performed on the intermediate actuating body by means of a pushbutton, while preserving efficient transmission of the desired touch action during the second phase or part of the operating stroke aimed at establishing the electrical switching path.

The present invention aims to overcome these drawbacks.

SUMMARY

This document describes a touch-action electric switch of the type comprising a bottom movable electrical contact which is for example dome-shaped and on which an operating pushbutton acts indirectly by means of a single-piece body made of elastic material, having a design such that, during a first phase of the operating stroke of the pushbutton, a pre-load effect is obtained and then, during a second phase of the operating stroke, a movable part of the bottom movable electrical contact is operated so as to establish an electrical switching path.

To this end, this document describes an electric switch of the type mentioned above. The switch may include a housing made of insulating material and comprising a bottom base defining a seat open vertically upwards. The switch may include a plurality of fixed, separate, electrical contacts which are arranged on a surface of the said base directed vertically upwards and which comprise at least one first, fixed, electrical contact and one second, fixed, electrical contact; a movable electrical contact which is arranged above the said surface of the base and which comprises a first non-movable portion making electrical contact with the said first, fixed, electrical contact and a second portion movable, vertically downwards, towards the said second, fixed, electrical contact. The switch may include a single-piece actuating body made of elastic material, arranged in the base. The actuating body may include a top central part comprising: a bottom bearing portion which is directed downwards towards the second movable portion of the movable electrical contact; and a top force-receiving actuating portion designed to receive an actuating force directed generally vertically downwards. The actuating body also may include a bottom peripheral part supporting the elastic actuating body in relation to the housing. The actuating body also may include a wall part connecting together the top central part and the bottom peripheral part. The switch may also include a top central pushbutton having a central actuating surface for acting on the said top force-receiving portion, in which: (i) the movable contact is arranged so that: in a normal rest state, the second movable portion of the movable electrical contact is spaced from the said second fixed electrical contact; and (ii) when it is subjected to an actuating force of predetermined value in a vertically downwards direction, the second movable portion of the movable electrical contact makes contact with the second fixed electrical contact so as to connect electrically the first fixed electrical contact and second fixed electrical contact.

According to a first embodiment, the touch-action electric switch may be characterized in that: the actuating body made of elastic material may include a top lateral part surrounding the said top force-receiving portion of the top central part of the actuating body, which is designed to receive an actuating force directed vertically downwards. The central pushbutton may include a lateral actuating surface for acting on the top lateral part of the actuating body made of elastic material. During a first phase of the operating stroke of the pushbutton, the central actuating surface of the pushbutton acts on the top force-receiving portion and elastically deforms the thin wall part. During a second phase of the operating stroke of the pushbutton, the lateral actuating surface of the pushbutton acts on the top lateral part.

According to a second embodiment, the touch-action electric switch may be characterized in that: the actuating body made of elastic material may include a top lateral part surrounding the top force-receiving portion of the top central part of the elastic actuating body, which is designed to receive an actuating force directed vertically downwards. The pushbutton may include a lateral actuating surface for acting on the said top lateral part of the elastic actuating body. During a first phase of the operating stroke of the pushbutton, the lateral actuating surface of the pushbutton acts on the said top lateral part. During a second phase of the operating stroke of the pushbutton, the central actuating surface of the pushbutton acts on the top force-receiving portion and elastically deforms the wall part.

According to other characteristic features of either of the embodiments described above: the top lateral part surrounding the said top force-receiving portion of the top central part of the elastic actuating body may be a tubular cylinder section directed vertically upwards. The top lateral part may be bounded by a top, horizontal, annular, actuating face on which the lateral actuating surface of the pushbutton with a matching form acts. The top lateral part may be bounded by a top, annular, horizontal, actuating face with a torus-like profile on which the lateral actuating surface of the pushbutton with a frustoconical form acts. The top central part of the elastic actuating body may include a cylindrical part, the bottom bearing portion of which, directed downwards towards the second movable portion of the movable electrical contact, is bounded by a flat horizontal bearing face, and the top force-receiving actuating portion of which, designed to receive an actuating force directed generally vertically downwards, is bounded by a flat, horizontal, actuating face; the peripheral part supporting the elastic actuating body in relation to the housing is a frustoconical, tubular, bottom part; the said top lateral part in the form of a tubular cylinder section prolongs vertically upwards the frustoconical, tubular, bottom, peripheral part.

BRIEF DESCRIPTION OF THE FIGURES

Further characteristic features and advantages of the invention will become clear from reading of the detailed description which is provided below and which may be understood with reference to the attached figures in which:

FIG. 10 is an exploded perspective view of the main components of the electric switch shown in FIG. 9.

DETAILED DESCRIPTION

Figure 1:
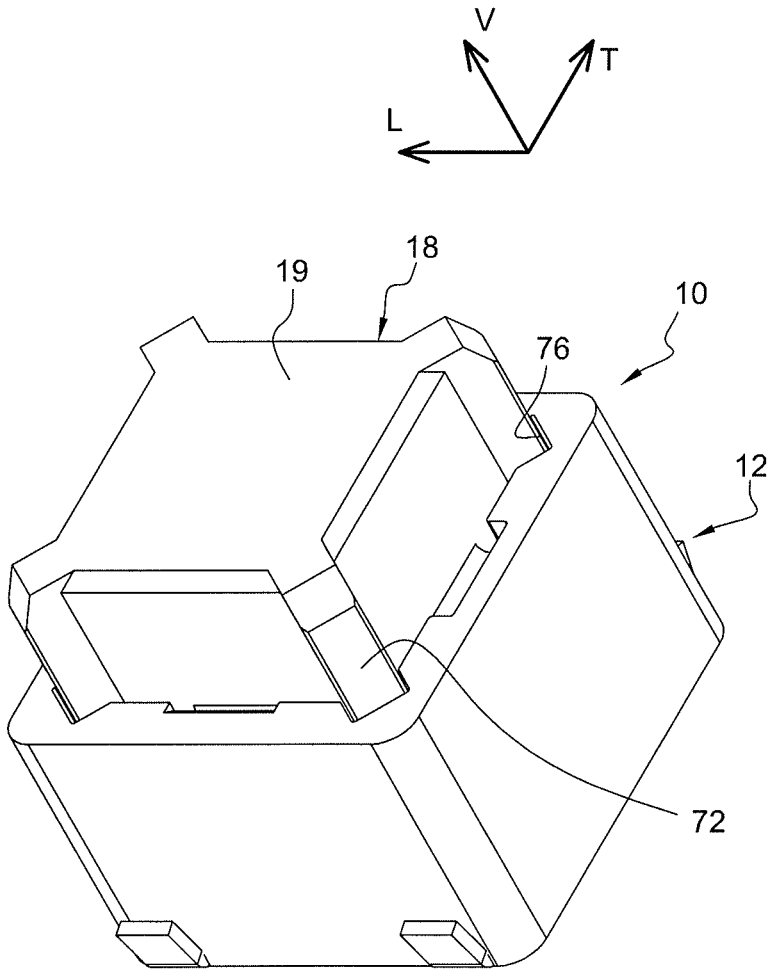
FIG. 1 is a perspective view of a first embodiment of an electric switch.
Figure 2:
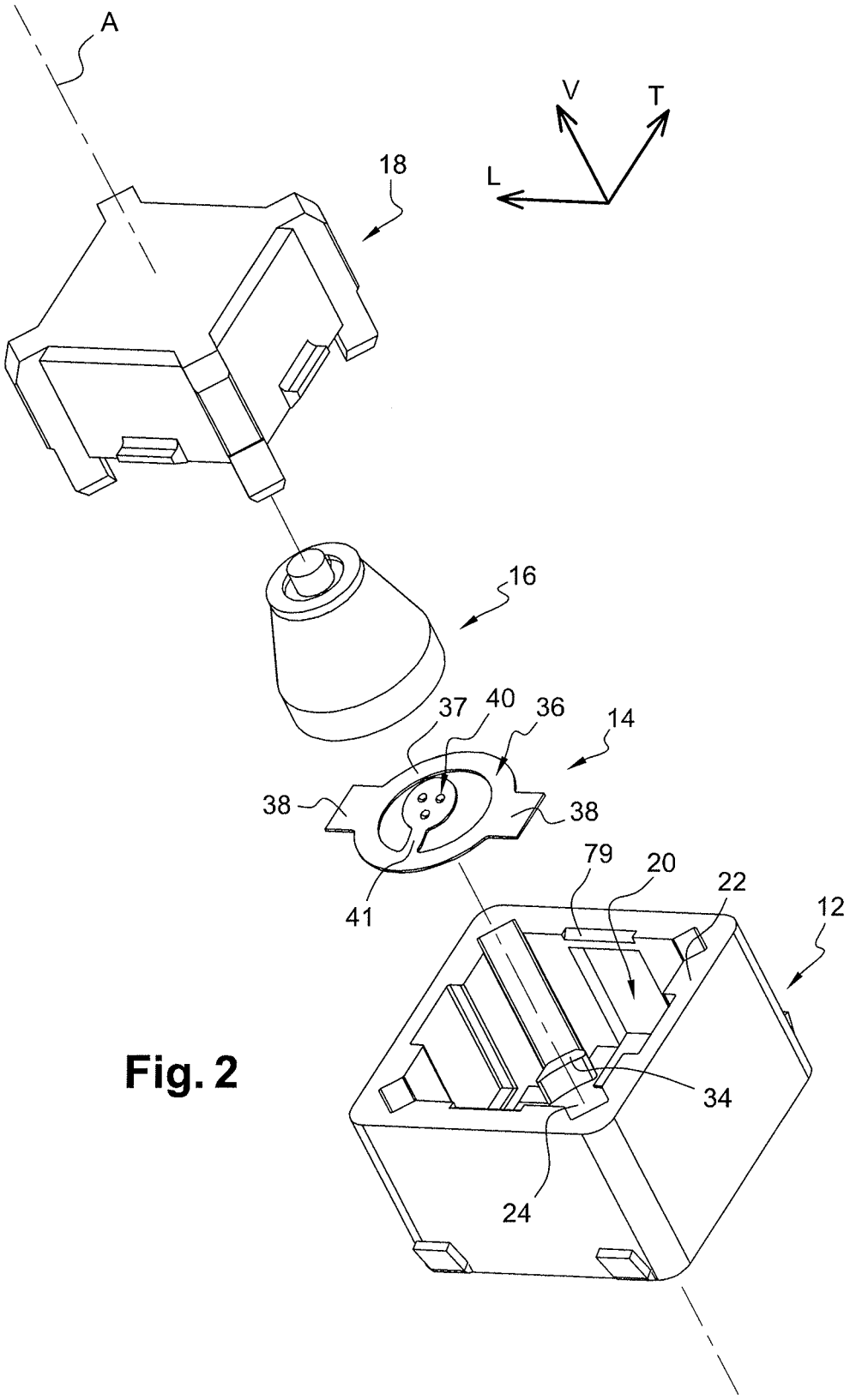
FIG. 2 is an exploded perspective view of the different components forming the electric switch shown in FIG. 1.
Figure 3:
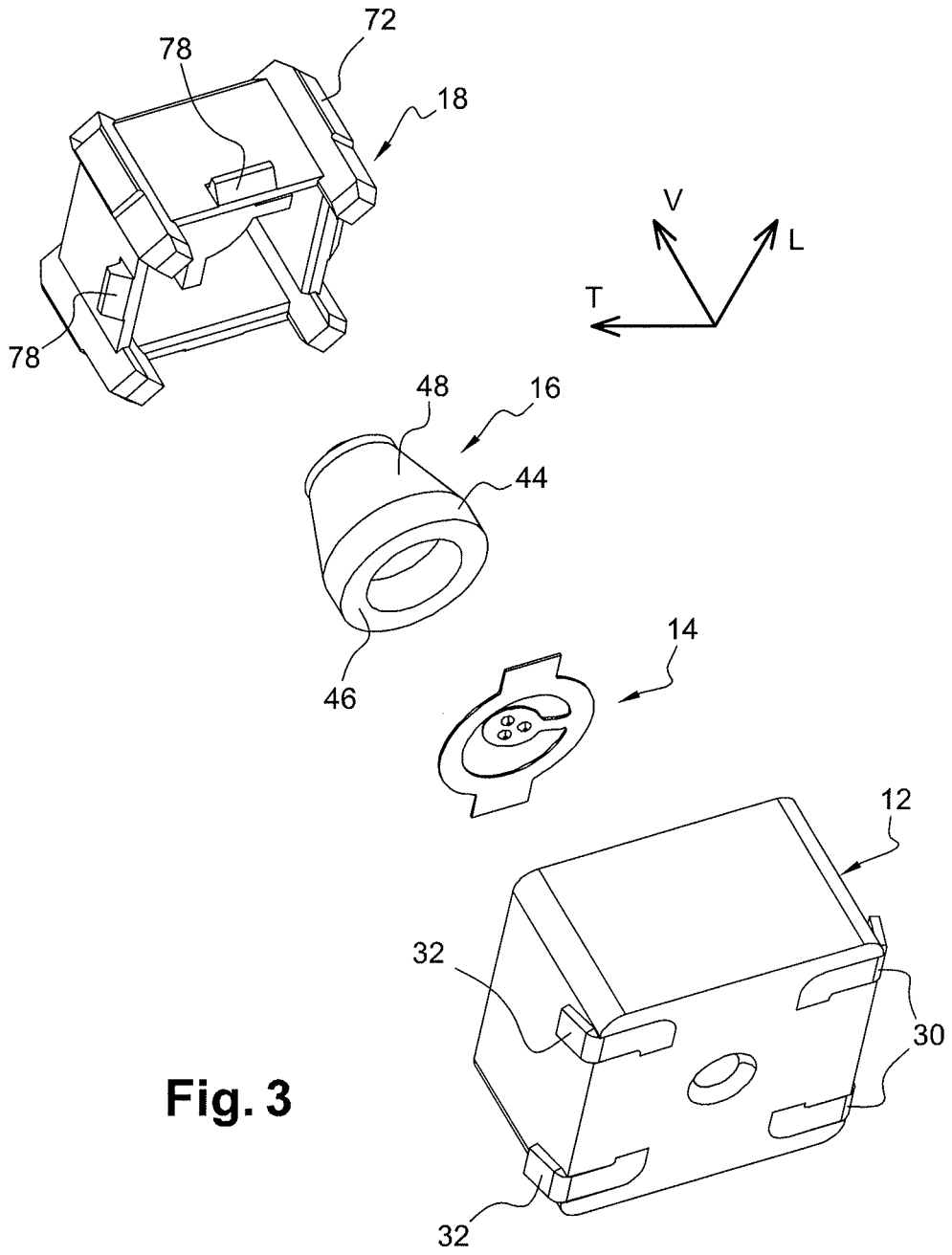
FIG. 3 is an exploded perspective view similar to that of FIG. 2, from another viewing angle.

In the description that follows, identical, similar or analogous components are designated by the same reference numbers. All patent documents referred to in this document are fully incorporated herein by reference. In this document, the singular forms "a," "an," and "the" include plural references unless the context clearly dictates otherwise. In this document, the term "comprising" means "including, but not limited to." Unless defined otherwise, all technical and scientific terms used herein have the same meanings as commonly understood by one of ordinary skill in the art.

In the description which follows, in order to facilitate comprehension thereof and of the claims, the terms "vertical", "horizontal", "top", "bottom", "transverse" and "longitudinal" will be used, without a limiting meaning and without reference to the earth's gravity, in relation to the three axes V, L, T shown in the figures.

In the description, components or elements which are identical, similar or analogous will be indicated by the same reference numbers.

First Embodiment (FIGS. 1 to 8)

FIGS. 1 to 5 in particular show an electric switch 10 essentially formed, vertically from the bottom upwards, by a bottom base 12, a movable electrical contact 14, an intermediate actuating body 16 and a top operating pushbutton 18.

These components are arranged vertically stacked along vertical operating axis A.

Figure 7:
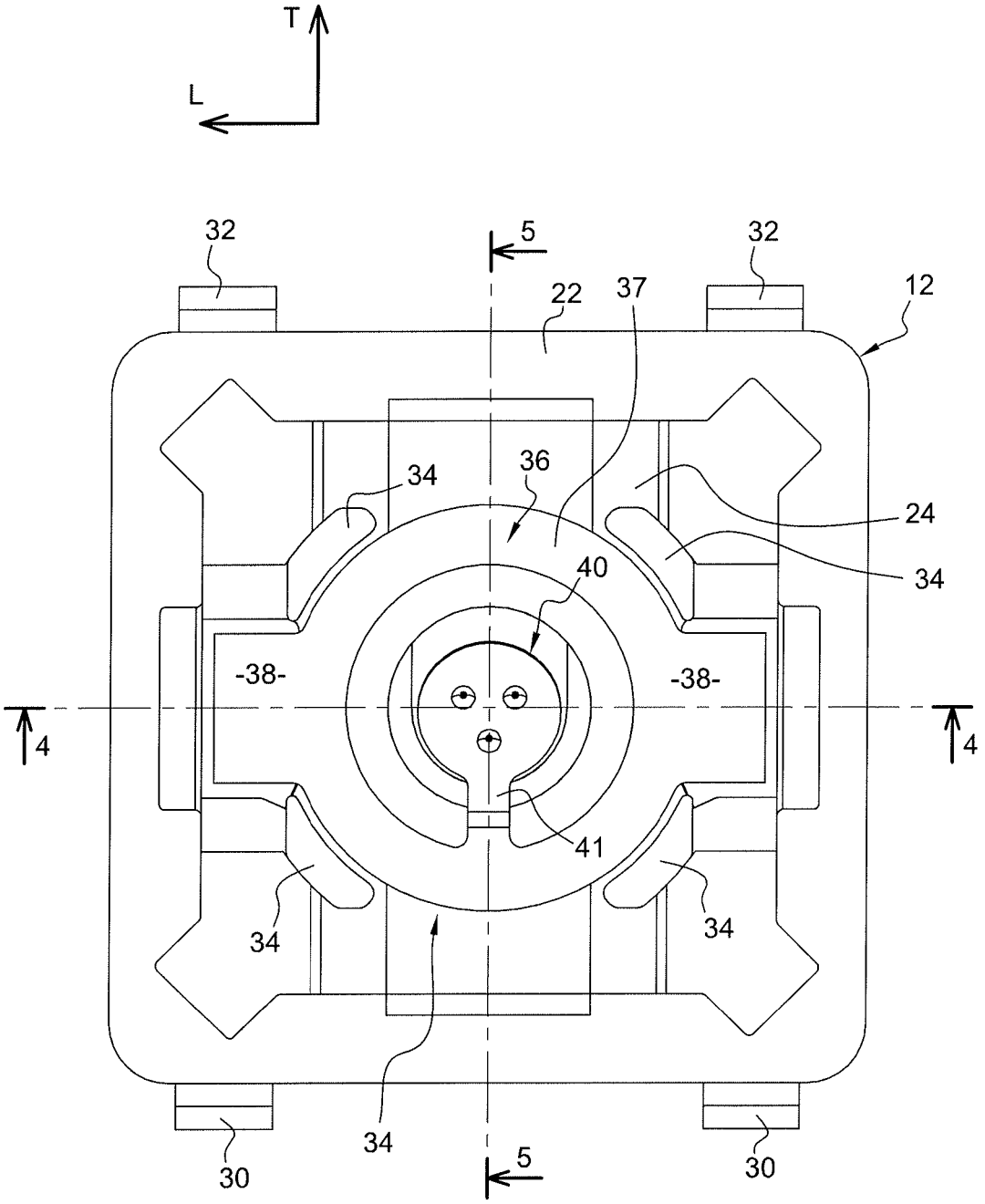
FIG. 7 shows a view, similar to that of FIG. 6, in which the movable electrical contact is shown in position mounted in the base shown in FIG. 6.

In the example of the first embodiment shown in the figures, the electric switch 10 has a dual symmetry in terms of its design relative to the vertical planes 4-4 and 5-5 indicated in FIG. 7.

By way of non-limiting example, the bottom part forming the base 12 has here a square parallelepiped form and is made of electrically insulating plastic material.

The base 12 defines an internal seat 20 which is open vertically upwards and which emerges inside a horizontal, flat, annular, top face 22 of the base 12.

Figure 6:
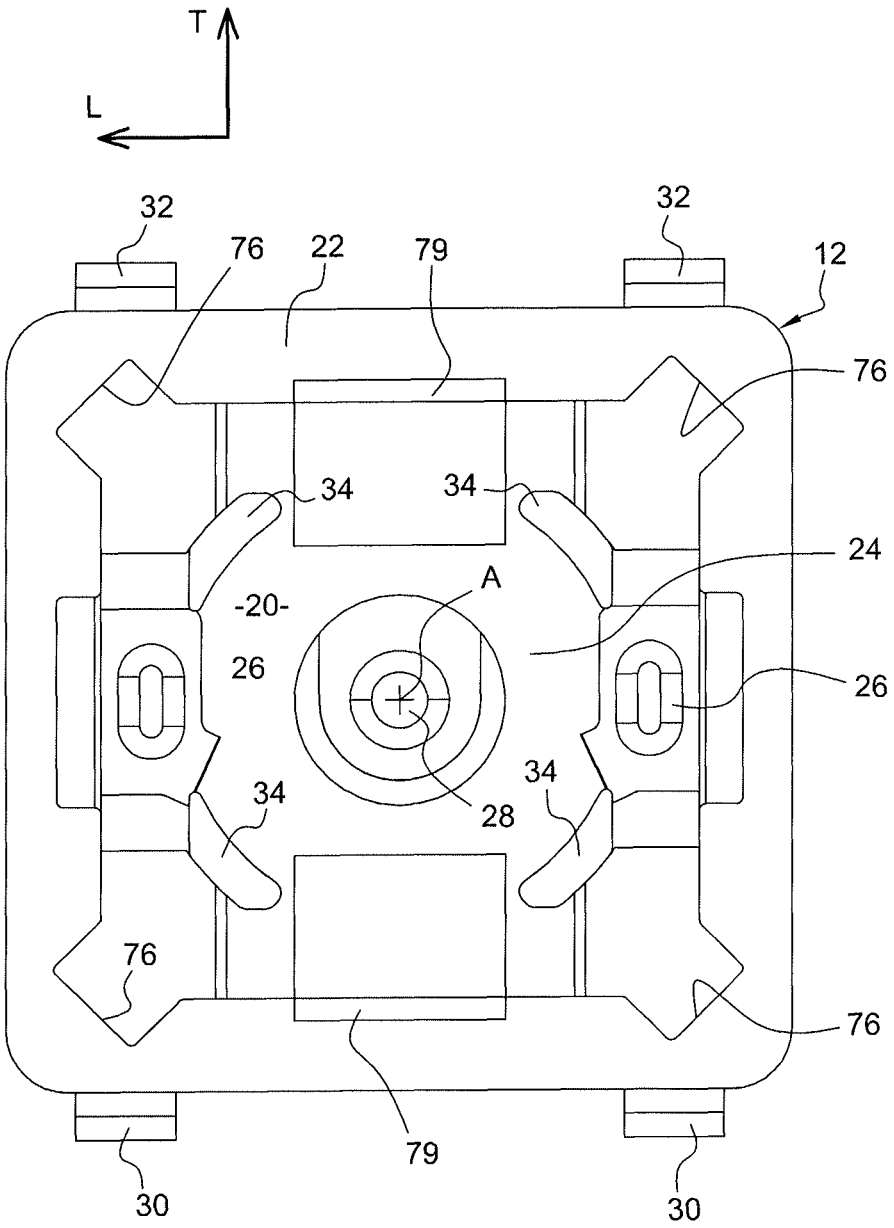
FIG. 6 is a view, from below, of the bottom part forming the base of the electric switch according to FIG. 1.

As can be seen in particular in FIG. 6, the seat 20 is bounded by a bottom horizontal surface 24 in which two first, opposite, fixed, lateral electrical contacts 26 and a second, fixed, central contact 28 are immovably arranged.

The first fixed contacts 26 are electrically connected to external electrical connection terminals 30, while the second, fixed, central contact 28 is connected to another pair of external connection terminals 32.

The base 12 also comprises four vertical lugs 34 for centring and positioning the movable electric contact 14.

As can be seen in particular in FIGS. 2 to 7, the movable electric contact 14 is arranged in position in the bottom base 12 and is positioned stably on the two first, fixed, lateral contacts 26.

The movable electrical contact 14 comprises a first part or annular lateral portion 36 which is not movable according to the invention and which, by means of its two lateral flanges 38, makes permanent electrical contact with the two fixed, lateral electrical contacts 26.

The movable electrical contact 14 comprises a second, disk-shaped, central portion 40 which is connected to the annular part 36 by means of a radial connecting lug 41 which is elastically deformable.

Figure 4:
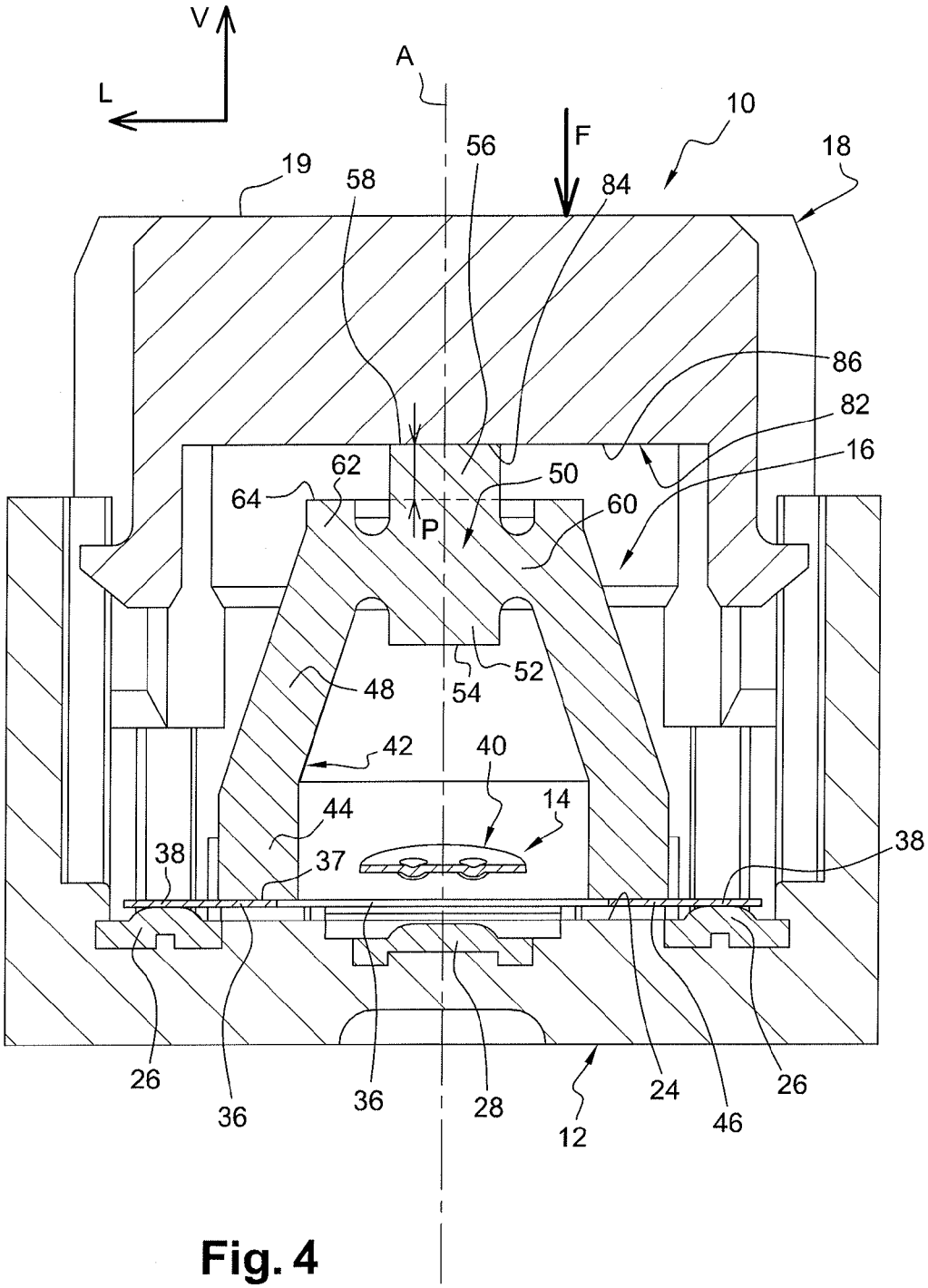
FIG. 4 is a cross-sectional view along the vertical and longitudinal mid-plane 4-4 indicated in FIG. 7.
Figure 5:
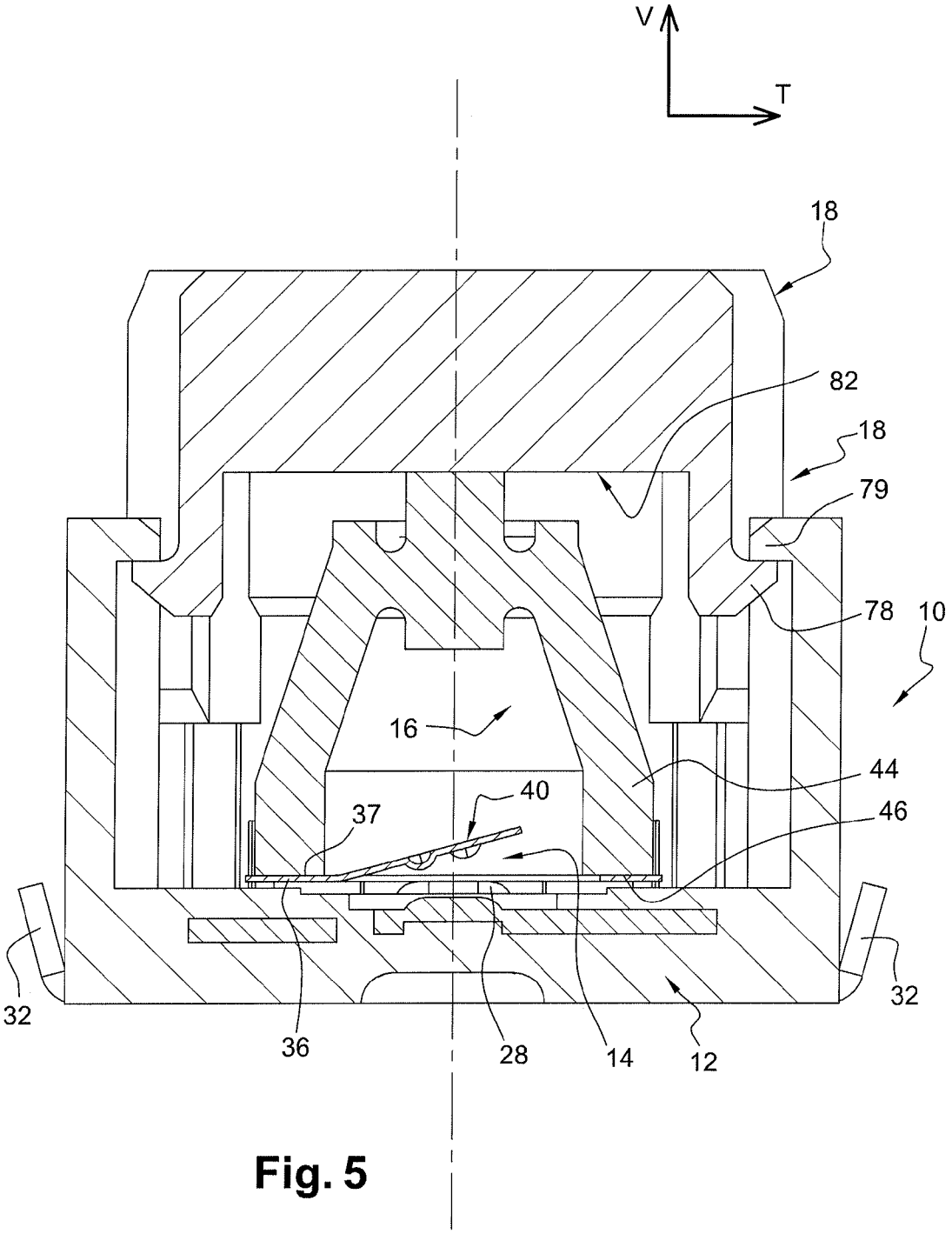
FIG. 5 is a cross-sectional view along the vertical and transverse plane 5-5 indicated in FIG. 7.

As can be seen in particular in FIGS. 4 and 5, the design of the movable electrical contact 14 and its arrangement in the bottom base 12 are such that, in its normal stable rest condition shown in the figures, the second, movable, central portion 40 of the movable electrical contact 14 is spaced vertically along the axis A of the top face of the second, fixed, central contact 28; namely, the electrical switching path between the first, fixed, lateral contacts 26 and the second, fixed, central contact 28 is not formed. There is no electrical switching path established between the external terminals 30 and 32.

The electrical contact 14 is movable according to the invention to the degree that it is elastically deformable when subjected to an actuating force of a predetermined value, in a vertically downwards direction, its movable central portion 40 thus being able to make electrical contact with the top face of the second fixed, central, electrical contact 28 so as to establish the electrical switching path between the first, fixed, lateral electrical contacts 26 and the second, fixed, central electrical contact 28 and therefore between the external connection terminals 30 and 32.

The central actuating body 16 is a component made as one piece of elastically deformable material such as an elastomer material or a natural or synthetic rubber.

The actuating body 16 is here a part having a form of revolution about the axis A.

The actuating body 16 comprises a bottom peripheral part 42, with a generally tubular form, which allows in particular the actuating body 16 to be supported inside the base of the switch.

For this purpose, the bottom peripheral part 42 comprises a bottom, cylindrical, tubular section 44 which is bounded by a bottom annular face 46 which rests vertically downwards on the top face 37 of the annular portion 36 of the movable electrical contact 14.

The bottom section 44 of the bottom peripheral part 42 is prolonged by a frustoconical tubular section 48 which extends vertically upwards.

The actuating body 16 thus comprises a top central part 50 which forms here a solid, axial, cylinder section.

The top central part 50 comprises a bottom bearing portion 52 which is directed vertically downwards towards the second movable portion 40 of the movable electrical contact 14 and is bounded by a bottom, horizontal, disk-shaped, bearing surface 54.

The bottom bearing portion 52 extends centrally inside the top part of the frustoconical tubular section 48.

The top central part 50 also comprises a top portion 56 for receiving an actuating force, which is designed to receive an actuating force directed generally vertically downwards, The top part 56 is bounded vertically upwards by a top, horizontal, disk-shaped, actuating face 58.

The actuating body 16 comprises a thin, annular, wall part 60 connecting together the top central part 50 and the bottom peripheral part 42.

For this purpose, the thin wall part 60 extends radially from a vertically intermediate zone of the top central part 50.

Finally, the actuating body 16 comprises a top lateral part 62 which surrounds the top force-receiving portion 56 of the top central part 50.

The top lateral part 62 is a short section of a tubular cylinder which is directed vertically upwards and which extends from the top part of the frustoconical section 48 and which is vertically bounded upwards by a horizontal, annular, top actuating face 64.

As can be seen in particular in FIGS. 4 and 5, in the initial rest condition of the switch, namely when the actuating body 16 is not deformed; the central actuating face 58 is vertically offset upwards in relation to the lateral actuating face 64 by a distance P.

The operating pushbutton 18 will now be described, said pushbutton being here, by way of a non-limiting example, and in this embodiment, a component forming also a lid for closing and retaining the components inside the bottom base 12 of the electric switch 10.

The operating pushbutton 18 is a moulded plastic part having a general square parallelepiped form matching that of the base 12.

The operating pushbutton 18 comprises essentially a top body 70 which has four external corner rails 72 which are slidably received inside matching vertical sliding guides 76 of the base 12.

The operating pushbutton 18 is assembled in the base 12 by means of deformation and an elastic interlocking fit and is retained therein in an upwardly vertical manner by means of four lateral lugs 78 forming hooking elements, two of which cooperate with facing matching parts 79 in the base 12.

Figure 8:
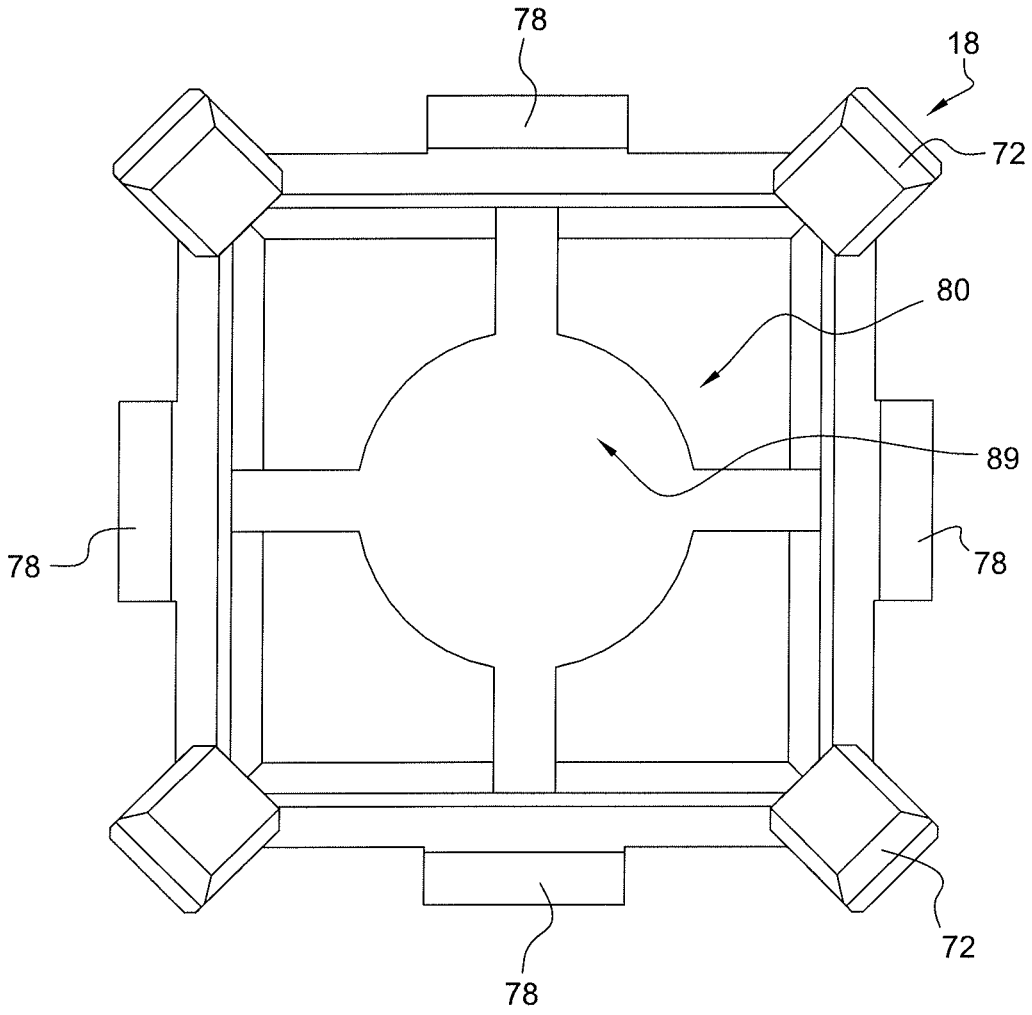
FIG. 8 shows a view from below of the pushbutton of the electric switch according to FIG. 1.

As can be seen in particular in FIGS. 4, 5 and 8, the top body 70 comprises a cylindrical central part 80 which is bounded in a vertically downwards direction by a bottom horizontal actuating face 82.

According to the invention, the bottom, horizontal, actuating face 82 of the operating pushbutton 18 comprises a central actuating surface 84 in the form of a disk which is situated at the bottom and directed vertically downwards and which makes contact with the top actuating face 58 of the actuating body 16.

The actuating face 82 of the actuating pushbutton 18 also comprises a lateral actuating surface 86 which is an annular centred portion of the face 82 which surrounds the central actuating surface 84 and which is able to cooperate with the lateral actuating face 64 of the actuating body 16.

The operating principle of the electric switch 10 according to this first embodiment is now described.

Starting from the normal rest position of the electric switch 10—which is a switch of the normally open NO type—an actuating force F is exerted in a vertically downwards direction on the top face 19 of the operating pushbutton 18.

The force F causes a vertically downwards displacement of the operating pushbutton 18 relative to the bottom base 12.

During the first phase of the operating stroke of the operating pushbutton 18 resulting from application of the force F (corresponding substantially to the distance P) the central actuating surface 84 acts on the surface 58 of the top force-receiving portion 56 causing an elastic deformation in particular of the thin wall part 60.

This elastic deformation during the first phase of the operating stroke corresponds to the so-called pre-load stroke of the electric switch 10.

When the lateral actuating surface 86 of the operating pushbutton 18 comes into contact with the top, lateral, actuating face 64 of the actuating body 16, the actuating pushbutton 18, by means of its actuating face 82, then acts simultaneously on the two surfaces 58 and 64 and causes simultaneous displacement of all the top part of the actuating body 16 thus causing an elastic deformation of the bottom portion 42.

During this second phase of the operating stroke, the bottom bearing portion 52, by means of its bottom, horizontal, bearing face 54, cooperates with the second movable portion 40 of the movable electrical contact 14 so as to bring (by causing the elastic deformation of the connecting lug 41) this part 40 into electrical contact with the second fixed, central, electrical contact 28 so as to cause "closing" of the electric switch and establish the electrical switching path.

In this design of the intermediate actuating body 16 the intermediate portion 42 is deformed and this produces a touch action which is transmitted to the operating pushbutton 18.

In this actuated or closed state, the actuating body 16 is in its maximum elastically deformed condition and is kept there by means of the actuating force F exerted on the top face 19 of the operating pushbutton 18.

When the actuating force F is no longer applied, the actuating body 16 exerts an elastic return force upwards on the pushbutton 18 until it assumes again its form and its normal rest condition shown in the figures. During this return phase, the movable part 40 of the movable electrical contact 14 also assumes again its normal rest state shown in the figures, thus interrupting the electrical switching path previously established.

In the assembled state of the components shown in the figures, and in particular in FIGS. 4 and 5, it is possible to provide a slight, axial, elastic prestressing force exerted by slight elastic deformation of the top part of the actuating body 16 so as to ensure elimination of the play of the electric switch 10 in its rest state.

In the example of realization of the first embodiment the top lateral part 62 of the actuating body 16 is shown in the form of a continuous tubular cylinder.

Without departing from the scope of the invention, this top lateral part may be designed with a discontinuous form and have several consecutive spaced sections which are for example distributed regularly in a circumferential manner.

Second Embodiment (FIGS. 9 to 15)

The second embodiment shown in FIGS. 9 to 15 will be described essentially by means of comparison with the first embodiment, highlighting differences in the structure and/or design which nevertheless result in the same modes of operation and achieve the same advantages according to the general inventive idea of the invention.

In the bottom base 12, the seat 20 which receives the movable electrical contact 14 is a seat having a cylindrical general form with a circular periphery bounded by a vertical, concave, cylindrical wall 21.

The movable electrical contact 14 is here, in a known manner, a dome-shaped element, the first non-movable portion of which is formed by its bottom annular peripheral part 36 which, by means of its bottom annular face, stably rests on the two first, fixed, lateral electrical contacts 26 and makes electrical contact therewith.

The second portion 40 which is movable, vertically downwards, towards the second central, fixed, electrical contact 28 is formed by the top central part 40 of the dome.

Figure 15:
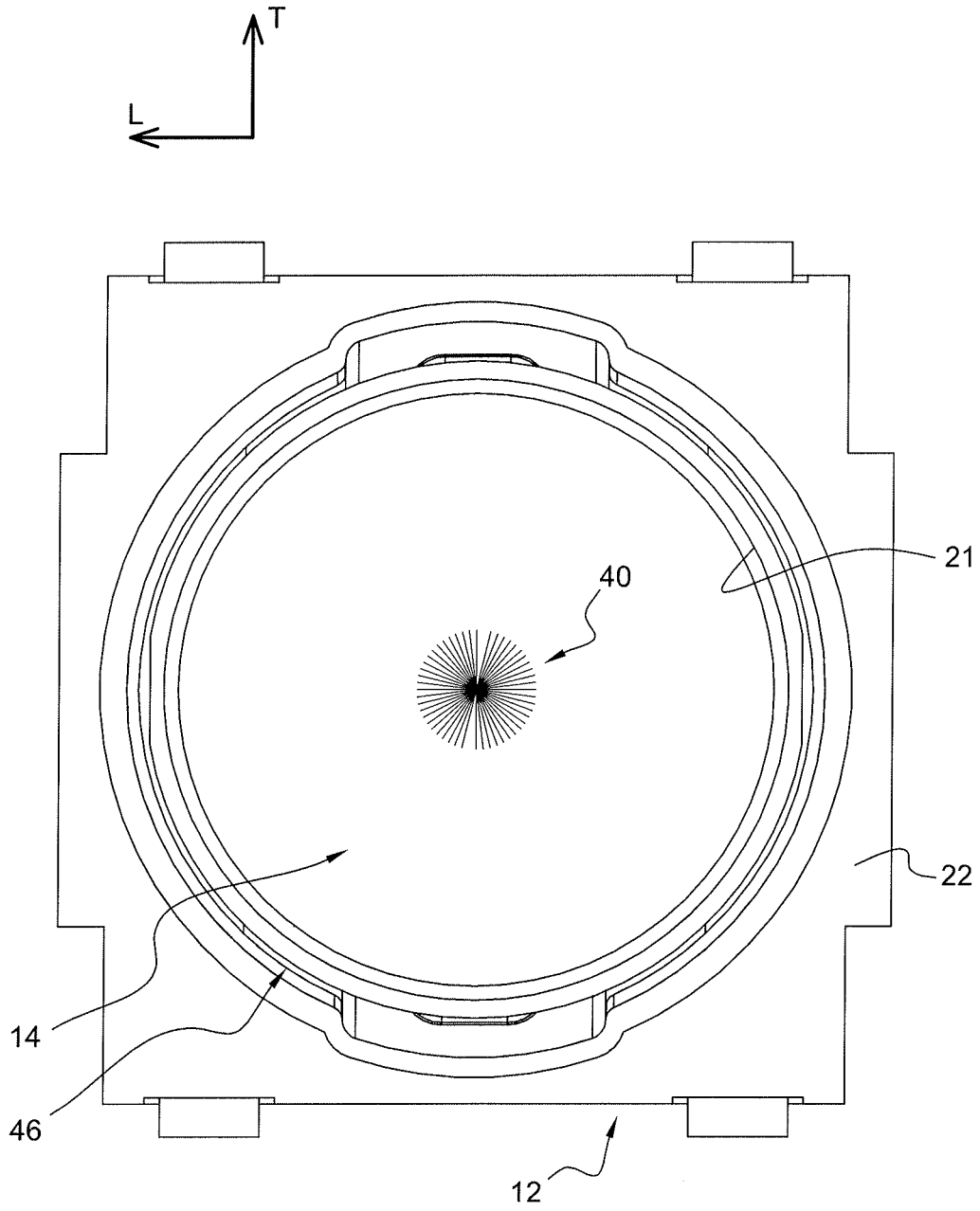
FIG. 15 shows a view, similar to that of FIG. 14, in which the movable electrical contact is shown in position in the bottom part forming the base.

The movable electrical contact element 14, as can be seen in FIG. 15, is housed and centred in the seat 20 inside the concave vertical cylindrical wall 21.

The intermediate actuating body 16 is made of elastic material and as one piece.

As can be seen in the figures, the actuating body 16 is in the form of a thick plate with a generally square periphery, the peripheral part 42 thereof being an annular portion of the square surrounding plate which supports the actuating body 16 relative to the bottom base 12 resting, via its horizontal bottom face 46, on the facing portions of the horizontal, top, annular face 22 of the bottom base 12.

The actuating body 16 comprises a top central part 50 which comprises a bottom bearing portion 52 which is bounded in the vertically downwards direction by a flat, horizontal, disk-shaped, bearing surface 54 which is directed towards the movable central portion 40 of the movable electrical contact element 14.

The top central part 50 also comprises a top portion 56 for receiving the actuating force, which is designed to receive an actuating force directed generally vertically downwards, For this purpose, the top portion 56 is bounded by a top, central, disk-shaped actuating face 58, which is here slightly concave with its concavity directed upwards.

The actuating body 16 comprises a thin wall part 60 which has a generally annular form and which extends in a horizontal plane so as to connect together the top central part 56 to the peripheral part 42.

The actuating body 16 also comprises a top lateral part 62 which surrounds the top force-receiving portion 56.

The top lateral part 62 is a cylinder section of generally tubular form, with a low height, which extends vertically upwards from the top horizontal face of the part 42, having here generally a profile in the form of a torus or semi-torus.

Thus, the top lateral part 62 is bounded by a top, annular, horizontal, actuating face with a torus-like profile 64.

The central operating pushbutton 18 is a rigid moulded plastic part which is essentially formed by a body 70.

The operating pushbutton 18 has a general cylindrical form and the bottom part of the body 70 is bounded by a bottom actuating face 82.

The bottom actuating face 82 comprises a central portion 84 with a flat, horizontal, disk-shaped, actuating surface which is designed to cooperate with the actuating face 58.

The face 82 also comprises an annular lateral portion of the actuating surface 86 which here has a convex frusto-conical profile, the convexity of which is directed vertically downwards and which is suitable for cooperating with the actuating surface 64.

Figure 9:
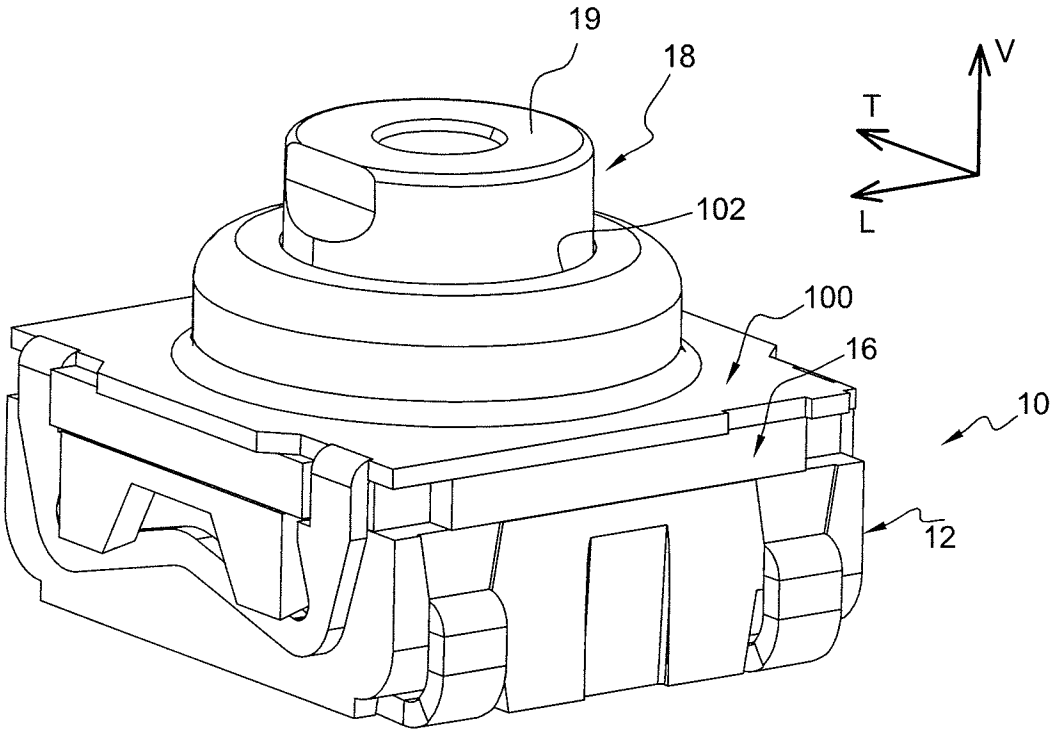
FIG. 9 is a perspective view of a second embodiment of an electric switch.
Figure 11:
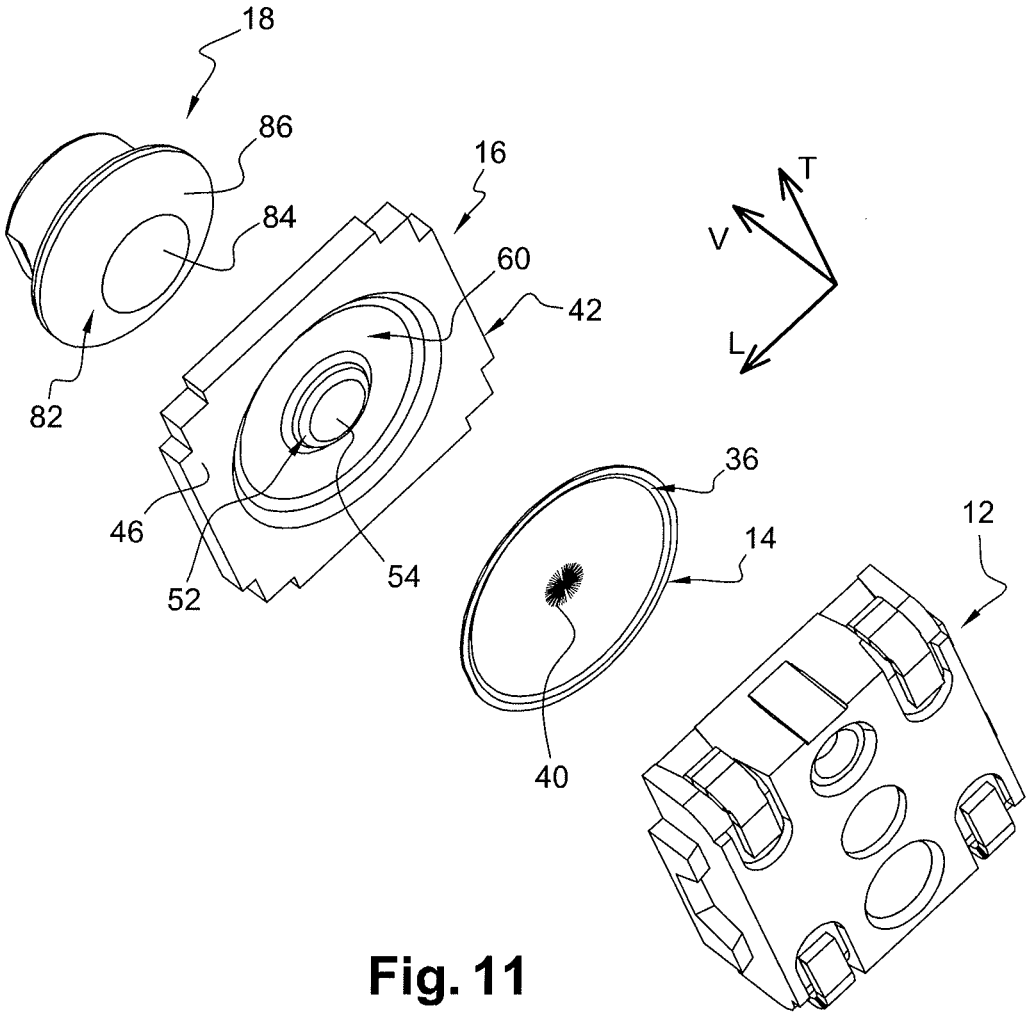
FIG. 11 is a perspective view similar to that of FIG. 10, from another viewing angle.
Figure 12:
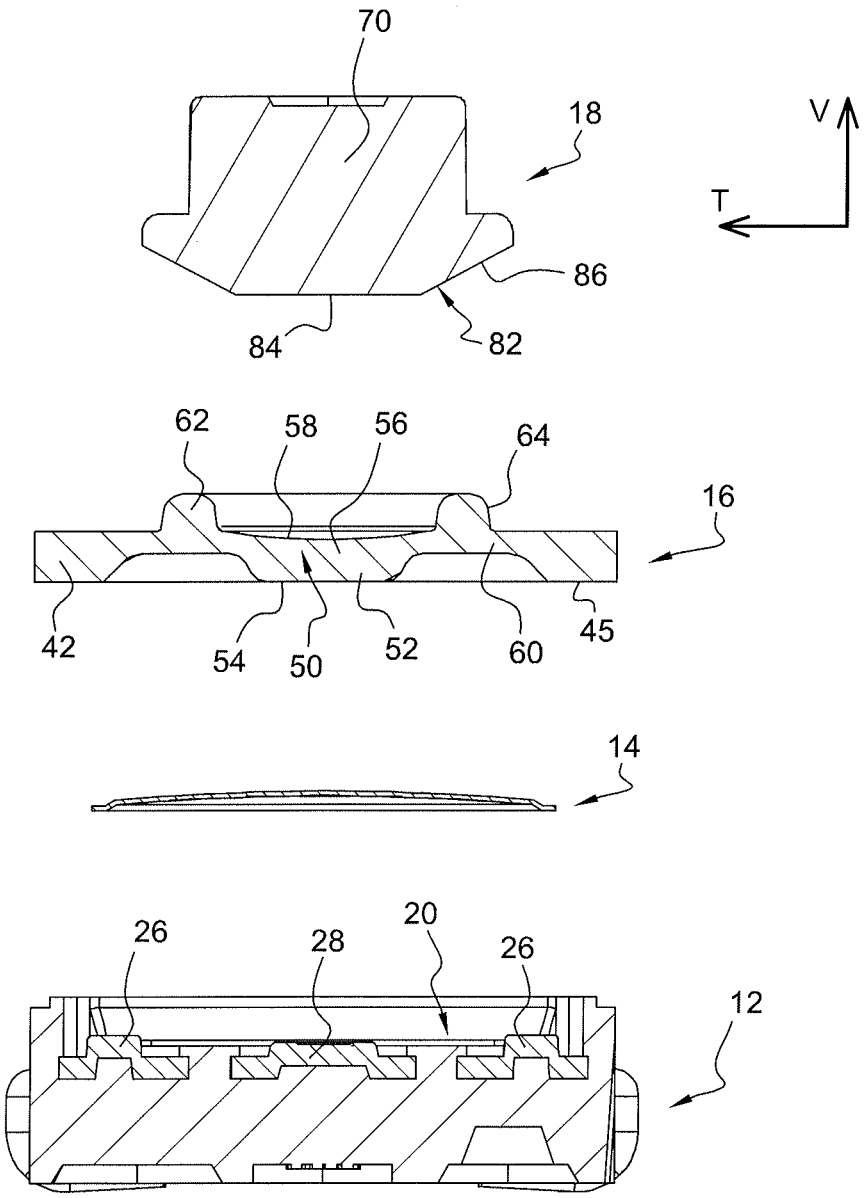
FIG. 12 is a cross-sectional view along a vertical and transverse mid-plane of the components shown in FIGS. 10 and 11.
Figure 13:
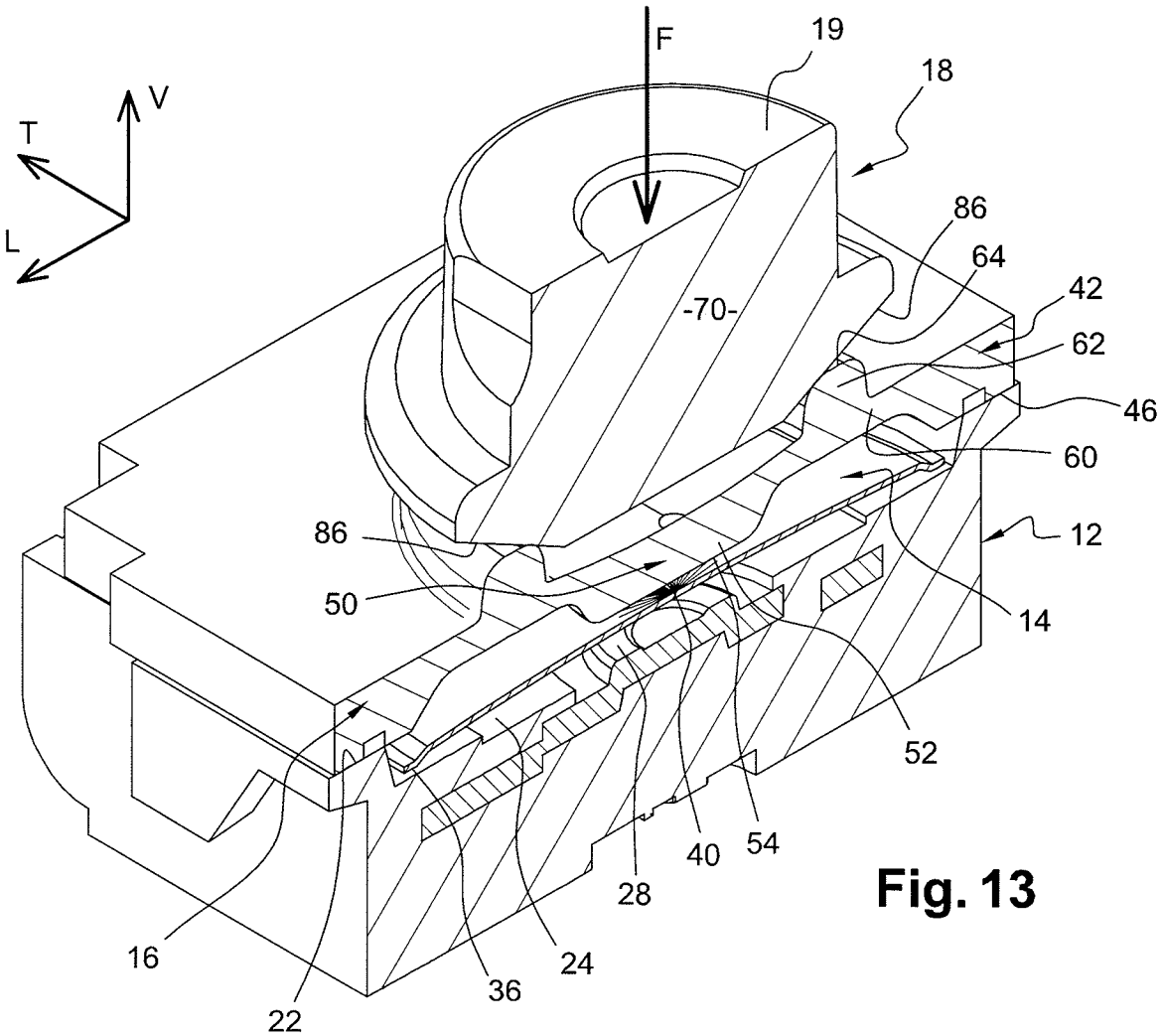
FIG. 13 is a perspective half view, sectioned along a vertical longitudinal mid-plane, of the main components of the electric switch shown in FIG. 1.
Figure 14:
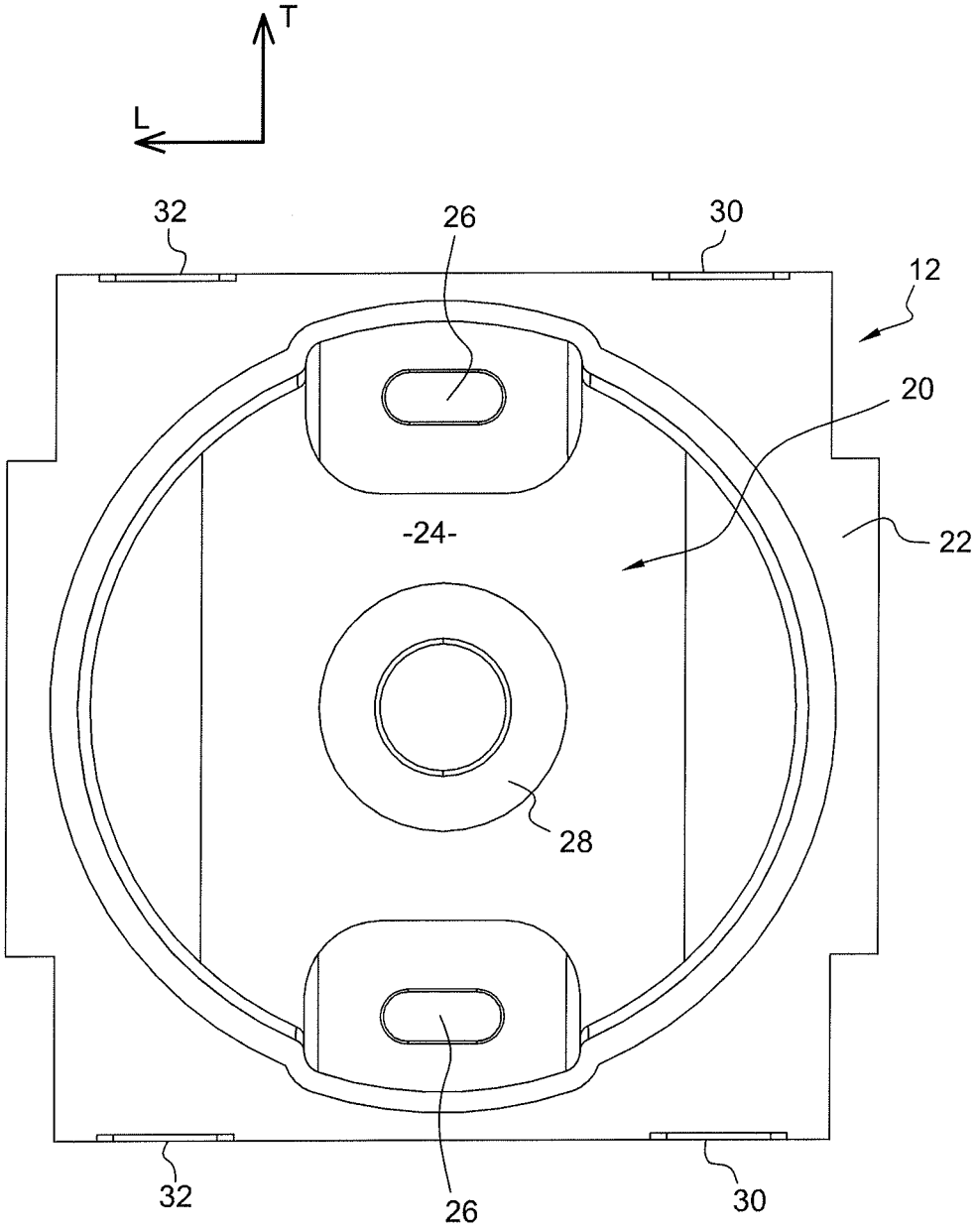
FIG. 14 is a view from above of the bottom part forming the base of the electric switch shown in FIG. 1.

As can be seen in FIG. 9, in order to form the electrical switch 10 and ensure closing of the whole unit and assembly of the different parts and components, in the position and the state shown for example in FIG. 13, the electrical switch 10 comprises a top cage 100 which is mounted crimped on the bottom base 12.

The top cage 100 comprises, in its top part, a central hole 102 through which the top portion of the body 70 of the actuating pushbutton 18 extends.

The operating pushbutton 18 may also slide freely vertically through the central hole 102, and centring thereof, as can be seen in particular in FIG. 13, is ensured by cooperation of the convex, annular, actuating surface 86 with the actuating surface, having a torus or semi-torus profile 64, of the top lateral part 62 of the actuating body 16.

The operating principle of the electric switch 10 according to this second embodiment is now described.

During the first phase of the operating stroke of the operating pushbutton 18, as a result of the action of the actuating force F which is applied to its top surface 19, the convex, annular, lateral actuating surface 86 of the body 70 of the actuating pushbutton 18 acts on the top lateral part 62 of the actuating body 16, "penetrating" inside this annular part and deforming it elastically together with an elastic deformation of the wall part 60.

This first part of the operating stroke continues until the central actuating surface 84 comes into contact with the actuating surface 58.

At the end of this first phase or part of the operating stroke corresponding to pre-loading, the operating pushbutton 18 acts simultaneously by means of its central surface portion 84 and its convex, annular, lateral, surface portion 86 on the actuating body 16 until, initially, the bottom bearing surface 54 comes into contact with the facing portion of the top face of the second, movable, central portion 40 of the electrical contact element 14.

The operating stroke continues causing an elastic deformation of the movable electrical contact 14 which suddenly changes state so as to make electrical contact, by means of its central part 40, with the second, fixed, central, contact element 28 so as to establish the electrical switching path as described above with reference to the first embodiment.

Here, the change in state and the contact made by the part 40 gives rise to a touch-action effect which is transmitted to the operating pushbutton 18.

In the example of realization of the second embodiment the top lateral part 62 of the actuating body 16 is shown in the form of a continuous ring.

Without departing from the scope of the invention, this top lateral part may be designed with a discontinuous form and have several consecutive spaced sections which are for example distributed regularly in a circumferential manner.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A touch-action electric switch comprising:

a housing made of insulating material and comprising a base defining a seat open vertically upwards;

a plurality of fixed, separate, electrical contacts which are arranged on a surface of the base directed vertically upwards and which comprise at least a first, fixed, electrical contact and a second, fixed, electrical contact;

a movable electrical contact which is arranged above the surface of the base and which comprises:

a first non-movable portion positioned to make electrical contact with the first, fixed, electrical contact, a second movable portion that is movable, vertically downwards, towards the second, fixed, electrical contact, a single-piece actuating body made of elastic material, arranged in the base and comprising:

(i) a top central part comprising:

a bottom bearing portion which is directed downwards towards the second movable portion of the movable electrical contact, and a top force-receiving actuating portion designed to receive an actuating force directed generally vertically downwards, (ii) a bottom peripheral part supporting the elastic actuating body in relation to the housing, and (iii) a wall part connecting together the top central part and the bottom peripheral part; and a pushbutton having a central actuating surface for acting on the top force-receiving portion;

wherein the movable electrical contact is arranged so that:

in a normal rest state, the second movable portion of the movable electrical contact is spaced from the second, fixed, electrical contact, and when the movable electrical contact is subjected to an actuating force in a vertically downwards direction, the second movable portion of the movable electrical contact will make contact with the second, fixed, electrical contact so as to connect electrically the first, fixed, electrical contact and second, fixed, electrical contact;

and wherein:

the actuating body made of elastic material comprises a top lateral part surrounding said top force-receiving portion of the top central part of the actuating body, which is positioned to receive an actuating force directed vertically downwards, the pushbutton comprises a lateral actuating surface for acting on the top lateral part of the actuating body, so that when operated, successively:

during a first phase of an operating stroke of the pushbutton, only the central actuating surface of the pushbutton will act on the top force-receiving portion and elastically deform the wall part, and during a second phase of the operating stroke of the pushbutton, the lateral actuating surface and the central actuating surface of the pushbutton will simultaneously act on the top lateral part.

2. A touch-action electric switch comprising:

a housing made of insulating material and comprising a base defining a seat open vertically upwards;

a plurality of fixed, separate, electrical contacts which are arranged on a surface of the base directed vertically upwards and which comprise at least a first, fixed, electrical contact and a second, fixed, electrical contact;

a movable electrical contact which is arranged above the surface of the base and which comprises:

a first non-movable portion positioned to make electrical contact with the first, fixed, electrical contact, and a second movable portion that is movable vertically downwards, towards the second, fixed, electrical contact, a single-piece actuating body made of elastic material, arranged in the base and comprising:

(i) a top central part comprising:

a bottom bearing portion which is directed downwards towards the second movable portion of the movable electrical contact, and a top force-receiving actuating portion positioned to receive an actuating force directed generally vertically downwards, (ii) a peripheral part supporting the actuating body in relation to the housing, and (iii) a wall part connecting together the top central part and the peripheral part, and a top central pushbutton having a central actuating surface for acting on the top force-receiving portion;

wherein the movable contact is arranged so that:

in a normal rest state, the second movable portion of the movable electrical contact is spaced from the said second, fixed, electrical contact, and when the movable contact is subjected to an actuating force in a vertically downwards direction, the second movable portion of the movable electrical contact will make contact with the second, fixed, electrical contact so as to electrically connect the first, fixed, electrical contact and second, fixed, electrical contact;

and wherein:

the actuating body comprises a top lateral part surrounding the top force-receiving portion of the top central part of the elastic actuating body, which is positioned to receive an actuating force directed vertically downwards, the pushbutton comprises a lateral actuating surface for acting on the top lateral part of the elastic actuating body, and so that when operated, successively:

during a first phase of an operating stroke of the pushbutton, only the lateral actuating surface of the pushbutton will act on the top lateral part, and during a second phase of the operating stroke of the pushbutton, the central actuating surface and the lateral actuating surface of the pushbutton will simultaneously act on the top force-receiving portion and elastically deform the wall part.

3. A touch-action electric switch according to claim 1, wherein the top central part of the actuating body is a cylindrical part, the bottom bearing portion of which, directed downwards towards the second movable portion of the movable electrical contact, is bounded by a flat horizontal bearing face, and the top force-receiving actuating portion of which, designed to receive an actuating force directed generally vertically downwards, is bounded by a flat, top, horizontal actuating face.

4. A touch-action electric switch according to claim 1, wherein the bottom peripheral part supporting the elastic actuating body in relation to the housing is a frustoconical, tubular, bottom part.

5. A touch-action electric switch according to either one of claims 1 or 2, wherein the top lateral part, surrounding the top force-receiving portion of the top central part of the actuating body is a tubular cylinder section directed vertically upwards.

6. A touch-action electric switch according to claim 5, wherein the top lateral part is bounded by a top, annular, actuating face on which the lateral actuating surface of the pushbutton acts.

7. A touch-action electric switch according to claim 5, wherein the bottom peripheral part supporting the elastic actuating body in relation to the housing is a frustoconical, tubular, bottom part; and the top lateral part in the form of a tubular cylinder section prolongs, vertically upwards, the frustoconical, tubular, peripheral, bottom part.

8. A touch-action electric switch according to claim 2, wherein the top lateral part, surrounding the top force-receiving portion of the top central part of the actuating body is a tubular cylinder section directed vertically upwards.

9. A touch-action electric switch according to claim 8, wherein the top lateral part is bounded by a top, horizontal, annular, actuating face with torus-like profile on which the lateral actuating surface of the pushbutton may act.

10. A touch-action electric switch according to claim 8, wherein the bottom peripheral part supporting the elastic actuating body in relation to the housing is a frustoconical, tubular, bottom part; and the top lateral part in the form of a tubular cylinder section prolongs, vertically upwards, the frustoconical, tubular, peripheral, bottom part.

* * * * *